US006267828B1

(12) United States Patent
Kushida et al.

(10) Patent No.: US 6,267,828 B1
(45) Date of Patent: Jul. 31, 2001

(54) LOW ALLOY STEEL FOR OIL COUNTRY TUBULAR GOODS AND METHOD OF MAKING

(76) Inventors: Takahiro Kushida, 4-1-603, Ohama 2-chome, Amagasaki, Hyogo (JP), 661-0022; Kaori Miyata, 2-1-408, Sakuraencho, Neyagawa, Osaka (JP), 572-0828; Kunio Kondo, 1-11-2, Yurinokidai, Sanda, Hyogo (JP), 669-1324; Tomohiko Omura, 33-1-106, Tadeharacho, Takano, Kyoto, Kyoto (JP), 606-8101

( * ) Notice: Subject to any disclaimer, the term of this patent is extended or adjusted under 35 U.S.C. 154(b) by 0 days.

(21) Appl. No.: 09/456,917

(22) Filed: Dec. 7, 1999

(30) Foreign Application Priority Data

Sep. 12, 1998 (JP) ..... 10-349460

(51) Int. Cl.[7] ..... C22C 38/22; C22C 38/24; C21D 8/00

(52) U.S. Cl. ..... 148/334; 148/328; 148/654; 148/663

(58) Field of Search ..... 148/654, 663, 148/328, 334

(56) References Cited

U.S. PATENT DOCUMENTS 5,226,978 * 7/1993 Hunt et al. ..... 148/328
6,162,307 * 12/2000 Hasegawa et al. ..... 148/328

FOREIGN PATENT DOCUMENTS

0828007 * 3/1998 (EP) .
02050916 * 2/1990 (JP) .
WO 9617964 * 6/1996 (WO) .

* cited by examiner

*Primary Examiner*—Deborah Yee

(57) ABSTRACT

A low alloy steel for oil country tubular well which has a yield stress of 110 ksi or above, and excellent sulfide stress cracking resistance. The low alloy steel comprises, by weight, 0.2 to 0.35% carbon, 0.2 to 0.7% chromium, 0.1 to 0.5% molybdenum, 0.1 to 0.3% vanadium, 0 to 0.5% silicon, 0 to 1% manganese, 0 to 0.1% aluminum, 0 to 0.1% niobium, 0 to 0.05% titanium, 0 to 0.005% boron, 0 to 0.1% zirconium, 0 to 1% tungsten, 0 to 0.01% calcium, 0.025% or less phosphorus, 0.01% or less sulfur, 0.01% or less nitrogen, and 0.01% or less oxygen. The low alloy steel further comprises a total amount of precipitated carbides between about 2 to 5% by weight, and a ratio of the MC type carbide to the total amount of the precipitated carbides is between about 8 to 40% by weight.

8 Claims, No Drawings

LOW ALLOY STEEL FOR OIL COUNTRY TUBULAR GOODS AND METHOD OF MAKING

This application claims priority under 35 U.S.C. § § 119 and/or 365 to JP10-349460 filed in Japan on Dec. 9th, 1998, the entire content of which is herein incorporated by reference.

FIELD OF THE INVENTION

The present invention relates to a low alloy steel with excellent sulfide stress cracking resistance, and more particularly, a low alloy steel with both a high strength and excellent corrosion resistance which is suitable to be used as a material for oil casing and tubing goods for an oil well and a gas well, and also drill pipes for drilling a well.

BACKGROUND OF THE INVENTION

Nowadays the tight condition for energy resources has increased the demand for drilling, transportation and storage of a crude oil and natural gas including hydrogen sulfide. Thus, materials to be used for these industries are required to provide a higher strength than in the past in order to meet the requirement of deeper drilling, more efficient transportation and the reduction of drilling cost by using a thinner pipe.

More particularly, typical steel pipes conventionally used have a yield stress (YS) of 80 to 95 ksi class. On the other hand, recently a steel pipe of 110 ksi class has been used, and the market is demanding a steel pipe of 125 ksi or above.

Among the steels with high sulfide stress cracking resistance (hereinafter referred to as SSC resistance), the following are known ; (a) a steel with martensitic microstructure of 80 to 90% or more, (b) a steel which is free from coarse carbides, (c) a clean steel containing less non-metallic inclusions, (d) a steel tempered at a high temperature, (e) a steel with fine grain sizes, (f) a steel having a high yield stress ratio, (g) a steel containing low Mn-low P-low S, (h) a steel containing abundant insoluble nitride, and (i) a steel added with zirconium.

There are various processes for producing a high strength low alloy steel having excellent SSC resistance. As a typical process, there is a rapid heating method, as disclosed in Japanese Laid-Open Patent Publications S54-117311 and S61-9519 and a short time tempering method, as disclosed in Japanese Laid-Open Patent Publications S58-25420.

Among conventional steels (a) to (i), the steel (b), which is free from coarse carbide was developed in consideration that coarse carbides trigger SSC.

A steel free from such coarse carbides can be produced by providing a quenching and a short time tempering treatment to a low alloy steel, which is designed to include chromium and other various elements in order to prevent coarse carbides from leaving, precipitating or growing, during the heat treatment.

In general, a steel which needs SSC resistance, is quenched to obtain a martensitic microstructure in which carbon exists in solution state, and thereafter tempered to allow precipitation of fine carbides. For this purpose, a low alloy steel which contains chromium so as to increase a hardenability of steel is usually used as a base steel.

In case of tempering treatment being exerted at a relatively low temperature, carbides precipitate in a film like state on prior austenitic grain boundaries. To prevent this, it is practiced that a suitable amount of molybdenum is added to a low alloy steel, which is tempered at a relatively high temperature.

Precipitated carbides grow to be coarse if the tempering process continues for a longer time, and therefore an induction heating is applied to shorten a tempering time.

Further, since carbides precipitate on grain boundaries and tend to grow, in order to achieve dispersion of carbides, the microstructure is made into fine grain by various methods.

As carbides which precipitate in a low alloy steel containing chromium and molybdenum, several types of carbide, such as $M_3C$ type, $M_7C_3$ type and $M_{23}C_6$ type, are conventionally known. Among them, $M_{23}C_6$ type carbide is liable to become coarse. In view of thermodynamics, those are more stable in due order of $M_3C$ type, $M_7C_3$ type and $M_{23}C_6$ type, and therefore coarse carbides of $M_{23}C_6$ type unavoidably precipitate in a quenched and tempered steel containing chromium and molybdenum. In case of an extremely large amount of molybdenum content, $M_2C$ type also precipitates. Since $M_2C$ type carbide is of a needle like shape and has a high stress concentration factor, it reduces SSC resistance.

Where, M represents metal, and means metallic elements such as iron, chromium, molybdenum, vanadium, etc. Specifically, $M_3C$ and $M_{23}C$ can be, for instance, $Fe_3C$, $Cr_{23}C_6$ and so on.

As for a precipitation control method of $M_{23}C_6$ type coarse carbide, a short time tempering process is most effective. As described above, this short time tempering process has been conventionally used. However, this short time tempering process essentially requires an induction heating facility, therefore requires a substantially large amount of capital investment.

Grain refining is also effective to control precipitation of coarse carbides. In order to achieve sufficient grain refining, however, it is necessary to conduct a heat treatment twice or more, and/or to carry out a quenching treatment at a lower temperature. As a result, not only the heat treatment costs increase, but also the amount of solution of alloy elements reduces, eventually necessitating an increase in the amount of alloy elements added, which results in increasing material costs. Further, since grain refining inevitably causes the deterioration of the hardenability, a rapid cooling is essential in order to obtain a martensitic microstructure. Therefore, special cooling equipments are required, thereby requiring a substantially large amount of capital investment.

There are various reports about how alloy elements affect a precipitation behavior of carbides and a SSC resistance in a chromium-molybdenum steel. For example, Metallurgical Transactions A. 16A, May 1985, p.935 "Sulfide Stress Cracking of High Strength Modified Cr-Mo Steels" reports that an addition of about 0.1% vanadium is effective to improve SSC resistance. The steel reported here, however, fails to achieve a desired degree of SSC resistance in NACE TM0177 solution under a condition of applying 85% stress of the specified minimum yield stress (SMYS).

SUMMARY OF THE INVENTION

The object of the present invention is to provide a low alloy steel for oil country tubular goods which has a high strength and excellent SSC resistance. More particularly, it is to provide a low alloy steel for oil country tubular goods which has a yield stress (YS) of 110 ksi (758 Mpa) or above, and is free from SSC in NACE TM0177 solution under a condition of applying 85% stress of the specified minimum yield stress (SMYS). Another object of the present invention is to provide a process for manufacturing such low alloy steel by conducting a simple heat treatment without using an induction heating facility or special cooling equipment.

The substance of the present invention is to provide a low alloy steel for oil country tubular goods which is excellent in sulfide stress cracking resistance and a process of manufacturing such steel as described below.

(1) A low alloy steel comprises, by weight, 0.2 to 0.35% carbon, 0.2 to 0.7% chromium, 0.1 to 0.5% molybdenum, 0.1 to 0.3% vanadium, 0 to 0.5% silicon, 0 to 1% manganese, 0 to 0.1% aluminum, 0 to 0.1% niobium, 0 to 0.05% titanium, 0 to 0.005% boron, 0 to 0.1% zirconium, 0 to 1% tungsten, 0 to 0.01% calcium, 0.025% or less phosphorus, 0.01% or less sulfur, 0.01% or less nitrogen, and 0.01% or less oxygen, with the balance iron and impurities. The low alloy steel further comprises a total amount of precipitated carbides between about 2 to 5% by weight. The precipitated carbides includes an MC type carbide and a ratio of the MC type carbide to the total amount of the precipitated carbides is between about 8 to 40% by weight.

(2) A process for manufacturing a low alloy steel comprises the steps of (a) preparing a steel having the above-mentioned chemical composition, (b) forming the steel into a a product shape, (c) quenching the steel at $A_3$ transformation temperature or higher, and (d) tempering the steel at a temperature of 650° C. or higher to $A_{c1}$ transformation temperature or lower.

The present invention is completed on the basis of the following findings. Namely, the inventors made detailed researches on how chemical composition of a steel and carbides affect SSC resistance, and have come to know the followings. There is an MC type carbide in addition to those of the above described $M_3C$, $M_7C_3$ and $M_{23}C_6$ types. $M_{23}C_6$ type carbide is liable to grow to be coarse, which diminishes the SSC resistance as described above.

On the other hand, MC type carbide is the most fine in size and least liable to grow to be coarse, and thus improves the SSC resistance. If the ratio of MC type carbide to the total carbide is controlled to be 8 to 40% by weight, with the total amount of carbide contents being limited to 2 to 5% by weight, the steel shows a sharp improvement in SSC resistance, and secures excellent SSC resistance in NACE TM0177 solution even under the condition of applying 85% stress of the specified minimum yield stress (SMYS). However, simply increasing the amount of MC type carbide content adversely diminishes the SCC resistance. This may be because the following reasons.

Since MC type carbide is fine, it has a larger interface area with the matrix per unit volume compared with other coarse carbides. Therefore if the amount of such carbide increases excessively, the amount of trapped hydrogen increases, and eventually reducing the SSC resistance of the steel. In fact, it was confirmed that a steel containing MC type carbide of more than 40% of the total amount of carbide, has higher absorbed hydrogen concentration than those containing MC type carbide of 40% or less, and thus has a relatively inferior SSC resistance.

The reason that a steel has less SSC resistance in case of the total amount of carbide contents exceeds 5%, may be explained similarly.

In the above case, said steel must have a chemical composition which contains as essential elements, by weight %, 0.2 to 0.35% carbon, 0.2 to 0.7% chromium, 0.1 to 0.5% molybdenum, and 0.1 to 0.3% vanadium. The reason for this is as follows.

If the content of carbon and of chromium exceeds the above-described upper limit, respectively, the total amount of carbides will exceed the upper limit of 5%. Further, if the content of vanadium exceeds the above-described upper limit, the content ratio of MC type carbide will exceed the upper limit of 40%. The excess carbide of which content exceeds the upper limit leads to an increase of absorbed hydrogen concentration and thus diminishing the SSC resistance.

'M' of MC type carbides consists mainly of vanadium, and also chromium and molybdenum. In particular, molybdenum is inclined to coexist with vanadium. If molybdenum content in a steel exceeds the upper limit of 0.5%, MC type carbide contains an extremely large amount of molybdenum. It is found that the MC type carbide is still relatively coarse in comparison with a MC type carbide formed when molybdenum content is 0.5% or less, although it is relatively fine in size compared with other types of carbides. Therefore, even if the content ratio of MC type carbide to the total amount of carbide content remains within the range of 8 to 40%, the interface area which traps hydrogen increases. As a result, the absorbed hydrogen concentration increases, and eventually impossible to secure the required SSC resistance.

Conventionally, the development of manufacturing process for such steel has been advanced in the direction of increasing molybdenum content in order to increase a resistance to temper softening and improve the SSC resistance. However, the above-described finding means unexpected result was obtained, that is, in case of the steel added with vanadium, the lower content of molybdenum improves the SSC resistance more.

It is also found that the above-described content ratio of MC type carbide to the total amount of carbide can be obtained by an extremely simple quench-and-temper heat treatment in which the steel with the above described chemical composition is quenched at $A_3$ transformation temperature or higher, and then tempered at 650° C. or higher.

Accordingly, the present invention can provide a low alloy steel for oil country tubular goods which has a high strength and excellent sulfide stress cracking resistance. Such low alloy steel for oil country tubular goods can be manufactured by conducting a simply quench-and-temper heat treatment on a steel with a predetermined chemical composition without a specially arranged facility, thus achieving a low production cost. The low alloy steel of the present invention can be mainly and suitably used for oil country tubular goods, but it is not limited to such usage.

DETAILED DESCRIPTION OF THE INVENTION

Hereinafter, a low alloy steel for oil country tubular goods of the present invention and a process for manufacturing such steel are explained in detail. In the following description, % means % by weight unless otherwise stated.

CARBIDE

Total Amount:

A carbide is essential for a steel which has a chemical composition described below and is subjected to quenching and tempering treatments in order to achieve a high strength through precipitation hardening. In case of a steel with the total amount of carbide content being less than 2%, it is difficult to obtain a yield stress of 110 ksi or more. In contrast, if the total amount of carbide exceeds 5%, an interface area which traps hydrogen increases. As a result, the absorbed hydrogen concentration increases, and thereby diminishing the SSC resistance. Consequently, the total amount of carbide contents is determined to be 2 to 5%, and more preferably, 2.5 to 4%.

Ratio of MC Type Carbide Content to the Total Amount of Carbide:

MC type carbide prevents carbides from growing to be coarse, and effectively improves the SSC resistance. However, if a ratio of MC type carbide to the total amount of carbide is less than 8%, such effect is limited. In contrast, if the ratio exceeds 40%, an interface area which traps hydrogen increases, and the absorbed hydrogen concentration increases, thereby diminishing the SSC resistance. Consequently, the ratio of MC type carbide to the total amount of carbide is determined to be 8 to 40%, and more preferably, 10 to 35%.

Method of Measuring the Amount of Carbide Content:

The total amount of carbides and the ratio of MC type carbide to the total carbide were obtained by the following methods, respectively.

Method of Measuring the Total Amount:

The total amount of carbide is measured by; sampling a sample piece of weight $W_1$ from a test steel; immersing the sample piece in electrolyte (10% acetyl acetone-1% tetra methyl ammonium chloride-with the balance of methanol); subjecting the sample piece to electrolysis with current density of 20 mA/cm$^2$; measuring a weight $W_2$ of the extract (carbide) after being filtered through a filter with a mesh of 0.2 $\mu$m diameter; and dividing the weight $W_2$ by the weight $W_1$ of the sample piece.

Calculation of the Ratio of MC Type Carbide

The weight ratio of MC type carbide to the total amount of carbides is determined by conducting X-ray diffraction on a sample of the above-described extract (carbide) which is ground, and then calculating a ratio of intensity of diffraction of MC type carbide to that of $M_3C$ type carbide. Meanwhile, the carbide in a sample is directly observed by a transmission electron microscope. The weight ratio of main elements composing MC type and $M_3C$ type carbides is measured by an energy dispersion of X-ray (EDX). The X-ray diffraction on this sample is used as a calibration curve.

Chemical Composition of Steel

Carbon:

Carbon is necessary for increasing the hardenability through quenching and thereby improving the strength of the steel. However, the carbon content of less than 0.2% could not provide sufficient hardenability, thereby failing to achieve a desired strength (YS≧110 ksi). On the contrary, if the carbon content exceeds 0.35%, the total amount of carbides increases as well as the amount of trapped hydrogen increases, thereby leading to deteriorate the SSC resistance. From the above reason, carbon content is determined to be 0.2 to 0.35%, and more preferably 0.2 to 0.3%.

Chromium:

Chromium is an element which increases the hardenability through quenching and the strength as well as improves the SSC resistance. However, chromium content of less than 0.2% could not provide sufficient hardenability, thereby failing to achieve a desired strength (YS≧110 ksi). On the contrary, the chromium content exceeding 0.7% would increase the total amount of carbides, and also increase the amount of trapped hydrogen as well as allows $M_{23}C_6$ type coarse carbides to precipitate, thereby leading to deteriorate the SSC resistance. Further, in the environment where hydrogen sulfide exists, such high chromium content steel will invite acceleration of corrosion and accompanying increase in absorbed hydrogen concentration. Therefore, chromium content is determined to be 0.2 to 0.7%, and more preferably, 0.3 to 0.6%.

Molybdenum:

Molybdenum is an element, which increases, like chromium, the hardenability through quenching and the strength as well as increases a resistance to temper softening, thus improving the SSC resistance. However, molybdenum content of less than 0.1% would fail to achieve the above-described effect. In contrast, the molybdenum content exceeding 0.5% would not only allow MC type carbide to grow to be coarse and increase the amount of trapped hydrogen, but also allow $M_{23}C_6$ type coarse carbides to precipitate, thereby leading to deteriorate the SSC resistance. Therefore, molybdenum content is determined to be 0.1 to 0.5%, and more preferably, 0.2 to 0.4%.

Vanadium:

Vanadium is the most important element for the present invention. Vanadium precipitates preferentially MC type fine carbides during the tempering process, which will least trigger SSC. As a result, carbon is fixed in the steel, which prevent precipitation of $M_{23}C_6$ type carbides that incline to trigger SSC. However, if the vanadium content is less than 0.1%, the above described effect is not obtained. On the other hand, the content exceeding 0.3% would increase the amount of MC type carbides excessively, which lead to increase the amount of trapped hydrogen, and thus deteriorating the SSC resistance. Therefore, vanadium content is determined to be 0.1 to 0.3%, and more preferably, 0.15 to 0.25%.

A steel of the present invention can be achieved by a low alloy steel containing the above-described four elements as an essential element, and there is no specific limitation for other elements. However, the steel may contain the following elements for an industrial production of such steel.

Silicon:

Silicon may not be added in the steel, but it is preferable to add at least 0.05% or more in the absence of any other deoxidisers such as aluminum or manganese. In addition, silicon also helps to increase a resistance to temper softening, thus improve SSC resistance. Such effect appears evidently with silicon content of 0.1% or more. However, if silicon content exceeds 0.5%, the toughness of the steel is diminished. Therefore, silicon content, if any, is preferably 0.5% or less. The most preferable upper limit is 0.3%.

Manganese:

Manganese may not be added in the steel, but it is preferable to add at least 0.05% or more in the absence of any other deoxidisers and/or in case of improving the hot workability. However, if manganese content exceeds 1.0%, the toughness of the steel is diminished. Therefore, manganese content, if any, is preferably 1.0% or less. The most preferable upper limit is 0.5%.

Aluminum:

Aluminum may not be added in the steel, but it is preferable to add at least 0.005% or more in the absence of any other deoxidisers. However, if aluminum content exceeds 0.1%, the amount of inclusions increases, which diminishes the toughness of the steel. A steel pipe for oil well is often machined to provide a threading for connection at its end portion. In such machining process, an excessive content of aluminum is inclined to suffer from a defect in the threaded part due to such inclusions. Therefore, aluminum content, if any, is preferably 0.1% or less. The most preferable upper limit is 0.05%.

It should be note that aluminum in the present specification represents acid soluble aluminum.

Niobium:

Niobium may not be added in the steel, but if added, it makes grains fine, and hinders coarse carbides from precipitating in the grain boundary. Such effect can be obtained with niobium content of 0.005% or more. However, the effect is saturated at 0.1% content, while the niobium content of higher than 0.1% diminishes the toughness of the steel. Therefore, niobium content, if any, is preferably 0.1% or less. The most preferable upper limit is 0.05%.

Titanium:

Titanium may not be added in the steel, but if added it fixes nitrogen, existing as one of impurities in the steel, into as titanium nitride (TiN). Therefore, in case of adding boron mentioned below to the steel for the purpose of the hardenability improvement, titanium prevents boron from fixing nitrogen into boron nitride (BN), and thus keeps boron at a solution state, which is effective for improving the hardenability. Further, titanium other than those which fixes nitrogen into TiN exists in a solution state during the quenching process, and during the tempering process it precipitates as a fine compound such as titanium carbide and thereby enhancing a resistance to tempering softening. Such effect appears evidently with titanium content of 0.005% or more. However, if added more than 0.05%, it diminishes the toughness of the steel. Therefore, titanium content, if any, is preferably 0.05% or less. The most preferabe upper limit is 0.03%.

Boron:

Boron may not be added in the steel, but if added, it helps to improve the hardenability, in particular, for a steel product having a greater thickness. Such effect appears evidently with boron content of 0.0001% or more. However, if added more than 0.005%, it diminishes the toughness of the steel. Therefore, boron content, if any, is preferably 0.005% or less. The most preferable upper limit is 0.002%.

Zirconium:

Zirconium may not be added in the steel, but if added, it fixes nitrogen, existing as one of impurities in the steel, as nitride in the steel just as titanium does, and thereby facilitating hardenability improving effect of boron. Such effect appears evidently with zirconium content of 0.01% or more. However, if added more than 0.1%, it increases the amount of inclusions, which diminishes the toughness of the steel. Therefore, zirconium content, if any, is preferably 0.1% or less. The most preferable upper limit is 0.03%.

Tungsten:

Tungsten may not be added in the steel, but if added it enhances the hardenability through quenching and the strength like the above-described molybdenum, and increases a resistance to temper softening thereby improving the SSC resistance. Such effect appears evidently with zirconium content of 0.1% or more. However, this effect is saturated at the content of 1.0%, and the content of more than this saturation level only increases the material costs without obtaining any further effect. Therefore, tungsten content, if any, is preferably 1.0% or less. The most preferable upper limit is 0.5%.

Calcium:

Calcium may not be added in the steel, but if added it reacts with sulfur, exiting as one of impurities in the steel, to produce a sulfide and thus improves a configuration of inclusions, thereby improving the SSC resistance. Such effect appears evidently with calcium content of 0.0001% or more. However, the calcium content of more than 0.01% not only diminishes the toughness and the SSC resistance of the steel, but also inclines more likely to cause defects on the surface of the steel. Therefore, calcium content, if any, is preferably 0.01% or less. The most preferable upper limit is 0.003%.

The degree of the above-described effect which is brought about by calcium depends on the amount of sulfur content. Under the condition of insufficient deoxidization, calcium content adversely diminishes the SSC resistance. Therefore it is important to control the content of calcium in accordance with sulfur content and the degree of deoxidization.

Phosphorous:

Phosphorous exists inevitably in a steel , and the phosphorous content of more than 0.025% leads to its segregation in grain boundaries, which diminishes the SSC resistance. Therefore, phosphorous content is preferably 0.025% or less. The less phosphorous is contained, the more preferable in view of quality. However, the excessively low content of phosphorous adversely increases the material cost. In practical, phosphorous content of around 0.01% in the steel can be negligible.

Sulfur:

Sulfur exists inevitably in a steel just like phosphorous, and the sulfur content of more than 0.01% leads to its segregation in grain boundaries and producing sulfide inclusions, which diminishes the SSC resistance. Therefore, sulfur content is preferably 0.01% or less. The less sulfur is contained, the more preferable in view of quality, just like phosphorous. However, the excessively low content of sulfur adversely increases the material cost. In practical, sulfur content of around 0.002% can be negligible.

Nitrogen:

Nitrogen exists inevitably in a steel just like phosphorous and sulfur, and the nitrogen content of more than 0.01% diminishes the toughness and the hardenability of the steel. Therefore, nitrogen content is preferably 0.01% or less. The less nitrogen is contained, the more preferable in view of quality.

Oxygen:

Oxygen exists inevitably in a steel just like phosphorous, sulfur and nitrogen, and the oxygen content of more than 0.01% diminishes the toughness of the steel. Therefore, oxygen content is preferably 0.01% or less. Again, the less oxygen is contained, the more preferable in view of quality.

Process for Manufacturing

A steel according to the present invention can be manufactured by an ordinary method so as to make the low alloy steel to have the chemical composition described above. Thus prepared steel is subjected to a hot rolling process, for instance, a hot seamless pipe making process using Mannesmann-mandrel mill method, to be formed into a predetermined final shape of product such as a seamless pipe. Thereafter, thus formed pipe is subjected to a quenching-and-tempering heat treatment, thereby completing the process for manufacturing the product.

The reason for conducting such quenching-and-tempering heat treatment on the product formed into the predetermined shape is as follows: The steel with the chemical composition defined in the present invention needs to be once quenched to obtain a martensitic microstructure, and then to be tempered. If it does not follow these steps, the MC type carbides precipitate only insufficiently, thereby remaining coarse carbides and thus failing to obtain a desired degree of SSC resistance.

The quenching may be conducted at any temperature of higher than $A_3$ transformation temperature where there is not a particular upper limit. However, if the temperature of quenching exceeds 950° C., the grain size becomes coarse, thereby sharply diminishing the toughness of the steel. Therefore, the upper limit of temperature is preferably 950° C.

Tempering has to be conducted at the temperature of 650° C. or higher to $A_{c1}$ transformation temperature or lower. In case of the tempering temperature of lower than 650° C., MC type carbides precipitates only insufficiently, which may leave a film like cementite in grain boundaries. As a result, the SSC resistance diminishes. On the other hand, if the tempering temperature exceeds $A_{c1}$ transformation temperature, an austenitic phase appears, which makes it difficult to obtain a desired strength.

Additionally, prior to above-mentioned quenching-and-tempering heat treatment, after the hot rolling, a direct quenching treatment may be conducted at the temperature of 950° C. or higher. In this case, if thus treated steel is left stand for a long time after the direct quenching process, it may suffer from a season cracking. In order to prevent such cracking, it is therefore preferable to anneal the quenched steel at the temperature of 600° C. or lower.

EXAMPLES

Sixteen types of low alloy steels having, respectively, a chemical composition shown in Table 1 were prepared by using a 150 kg vacuum melting furnace. In this process, steel types A to D, E to H, I and J, K and L, M and N, and O and P are divided from the same molten steel, respectively, and then the various elements such as vanadium were added, and thereby producing steels having the chemical composition shown in Table 1.

Each of the resulting steels was heated and forged into a plate having a thickness of 20 mm, a width of 80 mm and a length of 250 mm. Then the plates were subjected to a quenching-and-tempering treatment under the various conditions shown in Table 2 so that all the plates were adjusted to have a yield stress of 110 ksi or above. For the purpose of comparison, some steel plates were subjected to a normalizing treatment at 1050° C. Also some other plates were subject to either a direct quenching or a direct quenching-and-annealing treatment in advance, and then placed under the treatment of quenching-and-tempering defined by the present invention so that the steel plates were adjusted to have a yield stress of 110 ksi or above.

TABLE 1

| Steel | Chemical composition (wt. %) | | | | | | | | | | | | | | | | | Transform temp. (° C.) | | |
|---|---|---|---|---|---|---|---|---|---|---|---|---|---|---|---|---|---|---|---|---|
| No. | C | Si | Mn | P | S | Cr | Mo | V | Al | Ti | B | Nb | W | Zr | Ca | N | O | $A_3$ | $A_{c1}$ | Remarks |
| A | 0.23 | 0.10 | 0.20 | 0.008 | 9 | 0.65 | 0.41 | *0.05 | 0.025 | 0.015 | 8 | — | — | — | — | 38 | 24 | 835 | 735 | Comp. E. |
| B | 0.23 | 0.10 | 0.21 | 0.008 | 9 | 0.65 | 0.40 | 0.10 | 0.025 | 0.015 | 8 | — | — | — | — | 39 | 25 | 845 | 738 | Inven. E. |
| C | 0.22 | 0.10 | 0.20 | 0.008 | 9 | 0.64 | 0.40 | 0.28 | 0.025 | 0.015 | 8 | — | — | — | — | 37 | 26 | 861 | 735 | |
| D | 0.23 | 0.11 | 0.20 | 0.008 | 9 | 0.64 | 0.40 | *0.35 | 0.025 | 0.015 | 8 | — | — | — | — | 38 | 29 | 867 | 735 | Comp. E. |
| E | 0.27 | 0.24 | 0.46 | 0.007 | 8 | 0.51 | 0.28 | *0.09 | 0.028 | 0.025 | 12 | 0.035 | — | — | — | 74 | 32 | 833 | 734 | |
| F | 0.27 | 0.24 | 0.47 | 0.007 | 8 | 0.50 | 0.29 | 0.16 | 0.027 | 0.026 | 11 | 0.035 | — | — | — | 77 | 35 | 841 | 733 | Inve. E. |
| G | 0.27 | 0.25 | 0.46 | 0.007 | 8 | 0.50 | 0.29 | 0.30 | 0.026 | 0.025 | 12 | 0.034 | — | — | — | 79 | 36 | 856 | 734 | |
| H | 0.26 | 0.24 | 0.47 | 0.007 | 8 | 0.51 | 0.28 | *0.39 | 0.027 | 0.027 | 12 | 0.034 | — | — | — | 84 | 39 | 867 | 734 | Comp. E. |
| I | 0.35 | 0.25 | 0.30 | 0.009 | 9 | 0.62 | 0.15 | 0.12 | 0.038 | 0.018 | 5 | 0.15 | — | — | — | 38 | 24 | 818 | 738 | Inven. E. |
| J | *0.38 | 0.25 | 0.30 | 0.009 | 9 | 0.62 | 0.14 | 0.12 | 0.038 | 0.018 | 6 | 0.15 | — | — | — | 38 | 24 | 813 | 738 | Comp. E. |
| K | 0.27 | 0.35 | 0.54 | 0.012 | 11 | 0.69 | 0.32 | 0.20 | 0.042 | 0.017 | 7 | — | 0.12 | — | — | 54 | 18 | 853 | 740 | Inven. E. |
| L | 0.27 | 0.35 | 0.54 | 0.012 | 11 | *0.80 | 0.33 | 0.20 | 0.042 | 0.018 | 7 | — | 0.12 | — | — | 55 | 19 | 853 | 742 | Comp. E. |
| M | *0.17 | 0.40 | 0.72 | 0.005 | 6 | 0.69 | 0.45 | 0.24 | 0.015 | 0.014 | 8 | — | — | — | 24 | 38 | 24 | 883 | 739 | |
| N | 0.20 | 0.40 | 0.72 | 0.005 | 6 | 0.39 | 0.45 | 0.24 | 0.015 | 0.014 | 8 | — | — | — | 23 | 38 | 24 | 876 | 734 | Inven. E. |
| O | 0.26 | 0.31 | 0.49 | 0.005 | 6 | 0.52 | *0.55 | 0.18 | 0.015 | 0.014 | 8 | — | — | 0.18 | — | 38 | 24 | 856 | 736 | Comp. E. |
| P | 0.27 | 0.30 | 0.50 | 0.005 | 6 | 0.51 | 0.50 | 0.18 | 0.029 | 0.018 | 15 | — | — | 0.15 | — | 44 | 25 | 852 | 735 | Inven. E. |

Note
1: The balance of the chemical composition is Fe and incidental impurities.
2: The content of S, B, Ca, N and O is shown by ppm.
3: The * mark shows outside the range defined by the present invention.
4: In the remarks. Inve. E. means the inventive example and Comp. E. means the comparative example.

TABLE 2

| Sample no. | Type of steel | Direct quenching temperature (° C.) | Tempering temperature (° C.) | Reheating-and-quenching temperature (° C.) | Tempering temperature (° C.) | Total amount of carbides (wt. %) | Ratio of MC typed carbide (wt. %) | Strength YS (ksi) | Strength TS (ksi) | SSC resistance | Remark |
|---|---|---|---|---|---|---|---|---|---|---|---|
| 1 | *A | | | 920 | 650 | 3.1 | *4.4 | 119 | 132 | X | Comparative Example |
| 2 | B | | | | | 3.0 | 9.5 | 121 | 135 | ○ | Inventive |
| 3 | C | | | | 660 | 2.4 | 34.4 | 122 | 137 | ○ | Example |
| 4 | *D | | | | | 2.4 | *42.3 | 122 | 145 | X | Comparative |
| 5 | *E | | | | 670 | 3.6 | *4.4 | 129 | 140 | X | Example |
| 6 | F | | | 950 | 680 | 3.4 | 9.5 | 131 | 141 | ○ | Inventive |
| 7 | G | | | | | 3.1 | 26.3 | 128 | 139 | ○ | Example |
| 8 | *H | | | | 690 | 2.7 | *43.1 | 130 | 146 | X | Comparative Example |
| 9 | I | | | 900 | 670 | 4.6 | 11.6 | 129 | 140 | ○ | Inventive Example |
| 10 | *J | | | | | *5.1 | 13.2 | 130 | 145 | X | Comparative Example |
| 11 | K | | | 920 | 680 | 3.4 | 14.3 | 130 | 144 | ○ | Inventive Example |
| 12 | *L | | | | | 3.4 | *4.5 | 135 | 148 | X | Comparative |
| 13 | *M | | | 950 | 640 | *1.7 | 30.8 | 126 | 145 | X | Example |

TABLE 2-continued

| Sample no. | Type of steel | Direct quenching temperature (° C.) | Tempering temperature (° C.) | Reheating-and-quenching temperature (° C.) | Tempering temperature (° C.) | Total amount of carbides (wt. %) | Ratio of MC typed carbide (wt. %) | Strength YS (ksi) | Strength TS (ksi) | SSC resistance | Remark |
|---|---|---|---|---|---|---|---|---|---|---|---|
| 14 | N | | | | 650 | 2.2 | 29.0 | 129 | 145 | ○ | Inventive Example |
| 15 | *O | | | 980 | 700 | 3.2 | *6.8 | 131 | 145 | X | Comparative Example |
| 16 | P | | | | | 3.3 | 13.1 | 132 | 145 | ○ | Inventive Example |
| 17 | C | | | normalizing | | 2.4 | *4.6 | 112 | 125 | X | Comparative |
| 18 | G | | | at 1050° C. | | 3.1 | *4.8 | 115 | 130 | X | Example |
| 19 | C | | | 880 | 650 | 2.5 | *52.2 | 118 | 135 | X | |
| 20 | G | | | 900 | 660 | 3.2 | *41.0 | 115 | 131 | X | |
| 21 | B | 1050 | | 920 | 670 | 3.1 | 13.5 | 125 | 147 | ○ | Inventive |
| 22 | F | | | 950 | 690 | 3.5 | 14.0 | 131 | 148 | ○ | Example |
| 23 | B | 950 | 550 | 920 | 660 | 3.1 | 12.8 | 124 | 136 | ○ | |
| 24 | F | 980 | 600 | 950 | 680 | 3.5 | 13.3 | 130 | 140 | ○ | |

Note:
*indicates values which are out of the range defined in the present invention.

Total amount of carbide content of the steel plate obtained by the heat treatment and a ratio of MC type carbide content to the total carbides content for each steel plate were examined by the previously described method.

Also a bar tensile test piece, as defined in NACE TM0177 Method A, which has a dimension of its parallel portion of 6.35 m in outside diameter and 25.4 mm in length, and its longitudinal direction being the rolling direction (L direction), was sampled from each of the resultant plate obtained by the heat treatment at its central portion and provided to a sulfide stress cracking test (hereinafter referred to as SSC test).

The SSC test was carried out according to a method defined in the NACE TM0177 Method A. More particularly, it is a constant load test in a 5% saline solution added with 0.5% acetic acid at 25° C., wherein hydrogen sulfide is saturated under one atmospheric pressure, with the applied stress being 85% of yield stress of each plate and the duration of test being 720 hours.

In this SSC test, those which had been free from any cracking was evaluated as excellent indicated with '○', and those suffered from a cracking as poor indicated with 'x'. The results are shown together with the total amount of carbides obtained and the ratio of MC type carbide to the total carbide, in Table 2.

As shown in Table 2, inventive examples of sample Nos. 2, 3, 6, 7, 9, 11, 14, 16, and 21 to 24 remained within the range defined in the present invention in terms of a chemical composition, a total amount of carbides and a ratio of MC type carbide contents to the total carbide, and were excellent in SSC resistance.

On the contrary, comparative examples of sample Nos. 1 and 5 contained a small amount of vanadium, and had the MC type carbide content ratio being below the lower limit of the range defined in the present invention, and thus showed poor SSC resistance. Sample Nos. 4 and 8 contained a excessive amount of vanadium, and had the MC type carbide content ratio being above the upper limit of the range defined in the present invention, and thus showed poor SSC resistance.

Also a comparative example of sample No. 10, which contained a large amount of carbon and in which the total amount of carbides exceeded the upper limit of the content range defined in the present invention, showed poor SSC resistance. Sample No. 12, which contained a large amount of chromium and in which the MC type carbide content ratio was below the lower limit defined in the present invention, showed poor SSC resistance. Sample No. 15, which contained a large amount of molybdenum and in which the MC type carbide content ratio was below the lower limit of the range defined in the present invention, showed poor SSC resistance.

Further, samples Nos. 17 and 18 were subjected to a heat treatment of normalizing in stead of quenching-and-tempering, and thus the MC type carbide content ratio was below the lower limit defined in the present invention. Therefore those samples showed poor SSC resistance. Finally, samples Nos. 19 and 20 were quenched at a low temperature. Therefore the steel fell in insufficient of solution of MC type carbides during the quenching, and allowed MC type carbides to precipitate excessively in the succeeding tempering process. As a result, those samples showed poor SSC resistance.

What is claimed is:

1. A low alloy steel comprising, by weight, 0.2 to 0.35% carbon, 0.2 to 0.7% chromium, 0.1 to 0.5% molybdenum, 0.1 to 0.3% vanadium, 0 to 0.5% silicon, 0 to 1% manganese, 0 to 0.1% aluminum, 0 to 0.1% niobium, 0 to 0.05% titanium, 0 to 0.005% boron, 0 to 0.1% zirconium, 0 to 1% tungsten, 0 to 0.01% calcium, 0.025% or less phosphorous, 0.01% or less sulfur, 0.01% or less nitrogen, and 0.01% or less oxygen, with the balance iron and impurities, the low alloy steel further comprising a total amount of precipitated carbides between about 2 to 5% by weight, the precipitated carbides including an MC carbide, wherein a ratio of the MC carbide to said total amount of the precipitated carbides is between about 8 to 40% by weight.

2. The low alloy steel according to claim 1, wherein said total amount of the precipitated carbides is between about 2.5 to 4% by weight.

3. The low alloy steel according to claim 1, wherein a ratio of the MC carbide to said total amount of the precipitated carbides is between about 10 to 35% by weight.

4. The low alloy steel according to claim 2, wherein a ratio of the MC carbide to said total amount of the precipitated carbides is between about 10 to 35% by weight.

5. A process for manufacturing a low alloy steel comprising the steps of:

(a) preparing a steel comprising, by weight, 0.2 to 0.35% carbon, 0.2 to 0.7% chromium, 0.1 to 0.5% molybdenum, 0.1 to 0.3% vanadium, 0 to 0.5% silicon, 0 to 1% manganese, 0 to 0.1% aluminum, 0 to 0.1% niobium, 0 to 0.05% titanium, 0 to 0.005% boron, 0 to 0.1% zirconium, 0 to 1% tungsten, 0 to 0.01% calcium, 0.025% or less phosphorous, 0.01% or less sulfur, 0.01% or less nitrogen, and 0.01% or less oxygen, with the balance iron and impurities;

(b) forming said steel into a product shape;

(c) quenching said steel at $A_3$ transformation temperature or higher; and (d) tempering said steel at a temperature of 650° C. or higher to $A_{c1}$ transformation temperature or lower;

(e) wherein the low alloy steel further comprises a total amount of precipitated carbides between about 2 to 5% by weight, the precipitated carbides including an MC carbide, wherein a ratio of the MC carbide to said total amount of the precipitated carbides is between about 8 to 40% by weight.

6. The low alloy steel according to claim 5, wherein said total amount of the precipitated carbides is between about 2.4 to 4% by weight.

7. The low alloy steel according to claim 5, wherein a ratio of the MC carbide to said total amount of the precipitated carbides is between about 10 to 35% by weight.

8. The low alloy steel according to claim 6, wherein a ratio of the MC carbide to said total amount of the precipitated carbides is between about 10 to 35% by weight.

* * * * *

UNITED STATES PATENT AND TRADEMARK OFFICE

CERTIFICATE OF CORRECTION

PATENT NO. : 6,267,828 B1
DATED : July 31, 2001
INVENTOR(S) : Kushida et al.

It is certified that error appears in the above-identified patent and that said Letters Patent is hereby corrected as shown below:

Title page,
Item [30] Foreign Application Priority Data, filing date should be -- Dec. 9, 1998 --
Item [56] References Cited, FOREIGN PATENT DOCUMENTS insert --

| | | |
|---|---|---|
| 54-117311 | 9/1979 | (JP) |
| 58-254420 | 2/1983 | (JP) |
| 61-9519 | 1/1986 | (JP) |
| 6-322478 | 11/1994 | (JP) -- |

Signed and Sealed this

Twenty-eighth Day of May, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,267,828 B1
DATED : July 31, 2001
INVENTOR(S) : Kushida et al.

It is certified that error appears in the above-identified patent and that said Letters Patent is hereby corrected as shown below:

Title page,
Item [30] Foreign Application Priority Data, filing date should be -- Dec. 9, 1998 --
Item [56] References Cited, FOREIGN PATENT DOCUMENTS insert

| | | | |
|---|---|---|---|
| -- | 54-117311 | 9/1979 | (JP) |
| | 58-254420 | 2/1983 | (JP) |
| | 61-9519 | 1/1986 | (JP) |
| | 6-322478 | 11/1994 | (JP) -- |

After "Primary Examiner" insert -- [74] *Attorney, Agent or Firm*: Clark & Brody --

Signed and Sealed this

Eighth Day of October, 2002

*Attest:*

*Attesting Officer*

JAMES E. ROGAN
*Director of the United States Patent and Trademark Office*

UNITED STATES PATENT AND TRADEMARK OFFICE

CERTIFICATE OF CORRECTION

PATENT NO. : 6,267,828 B1
DATED : July 31, 2001
INVENTOR(S) : Kushida et al.

It is certified that error appears in the above-identified patent and that said Letters Patent is hereby corrected as shown below:

Title page,
Insert:
-- [73] Assignee: Sumitomo Metal Industries, Ltd., Osaka, Japan --

Signed and Sealed this

Fourth Day of February, 2003

JAMES E. ROGAN
*Director of the United States Patent and Trademark Office*